US007269880B2

(12) United States Patent
Wallis et al.

(10) Patent No.: US 7,269,880 B2
(45) Date of Patent: Sep. 18, 2007

(54) DURA T GATE ADJUSTABLE HINGE 003

(76) Inventors: Thomas Lee Wallis, 1826 Broadmoor St., Livermore, CA (US) 94551; Sandra Marie Wallis Arellano, 1826 Broadmoor St., Livermore, CA (US) 94551

( * ) Notice: Subject to any disclaimer, the term of this patent is extended or adjusted under 35 U.S.C. 154(b) by 0 days.

(21) Appl. No.: 10/877,895

(22) Filed: Jun. 24, 2004

(65) Prior Publication Data

US 2006/0005355 A1 Jan. 12, 2006

(51) Int. Cl.
*E05D 7/04* (2006.01)

(52) U.S. Cl. ..... 16/237; 16/238

(58) Field of Classification Search ..... 16/237, 16/238 X, 276, 246, 245, 252, 236; 49/381, 49/239, 236; 200/61.7
See application file for complete search history.

(56) References Cited

U.S. PATENT DOCUMENTS 527,685 A * 10/1894 Haege ..... 16/240
586,146 A * 7/1897 Steinfeldt ..... 16/244
3,514,807 A * 6/1970 Triplett ..... 16/253
4,141,109 A * 2/1979 Farrell ..... 16/237
4,330,901 A * 5/1982 Sanders ..... 16/237
5,391,167 A * 2/1995 Pong et al. ..... 606/57
5,669,105 A * 9/1997 Depke ..... 16/245
5,822,832 A * 10/1998 Maggi ..... 16/276
6,073,396 A * 6/2000 Kietzmann ..... 49/381
6,725,504 B1 * 4/2004 Dickson et al. ..... 16/236
6,802,106 B2 * 10/2004 Taglianetti ..... 16/246

* cited by examiner

*Primary Examiner*—Brian E. Glessner
*Assistant Examiner*—Mark Williams

(57) ABSTRACT

The invention provides a metal hinge assembly with vertical and horizontal adjustment mounted onto the component of a gate. The top having a rotating support arm is machined with two mounting nuts, the first bolt extends horizontally with threaded rod to hold two nuts to support the gate. The second bolt extends into the shaft of the casing for horizontal and vertical adjustment. A valve extends from a casing for external lubrication. The bottom of the housing contains a chamber to allow the ball bearing smooth rotation allowing adjustment for distance. The bottom of the base has a chamber for the locking set screw to allow vertical adjustment, the bottom surface side of the base, thus rests against the edge of the side surface of a gate and is screwed in the base of the hinge, locking the bottom portion of the hinge to the top of the hinge.

1 Claim, 2 Drawing Sheets

A ~ PIVOT HOUSING
B ~ PIVOT
C ~ THREADED ROD
D ~ HEX NUTS
E ~ BALL BEARING
F ~ RETAINING SCREW
G ~ LUBRICATION FITTING
H ~ HEIGHT ADJUSTING SCREW

A ~ PIVOT HOUSING
B ~ PIVOT
C ~ THREADED ROD
D ~ HEX NUTS
E ~ BALL BEARING
F ~ RETAINING SCREW
G ~ LUBRICATION FITTING
H ~ HEIGHT ADJUSTING SCREW

A ~ PIVOT HOUSING
B ~ PIVOT
C ~ THREADED ROD
D ~ HEX NUTS
E ~ BALL BEARING
F ~ RETAINING SCREW
G ~ LUBRICATION FITTING
H ~ HEIGHT ADJUSTING SCREW

DURA T GATE ADJUSTABLE HINGE 003

FIELD OF THE INVENTION

The present invention relates to a hinge assembly attached between a metal door (doorjamb or gate post) for commercial use, particularly improving horizontal, vertical adjustment for gate doors.

BACKGROUND OF THE INVENTION

This invention relates to installation of a structure containing a horizontal, vertical adjustable hinge assembly for securing trash gate doors for commercial use, and more particularly to the installation structure of the hinge assembly that will secure the door to attach the hinge assembly and reinforce the strength of the door.

Large, metal gates have been in use for many years, typically, they include a hinge securing the door to a post which is either wood or metal. The door is generally attached to the hinge, when the door is opened, it opens horizontally. In new construction the gate conditions vary, the gate post is cast in concrete, the hole which is dug is always larger than the post, which stands in the concrete to attach the gate door to. When the concrete dries the position of the post varies. The gate door is stood up against the post, no allowance is given with the standard butt hinge. Another drawback with the standard butt hinge, having only a plate appearance with screw holes allows any tension nor force.

In an attempt to address this draw back a vertical, horizontal hinge assembly has been created. Between the gate and a post the hinge assembly, a force to counteract the weight and balance of the gate that address all the adversity of the conventional butt hinge as well as give robust strength to the gate.

A standard butt hinge does not allow for normal wear and tear, nor allow for shrinking in the heat, nor expansion in the cold. Another drawback of the conventional hinge is that no tension is provided, no exerted force can be allowed, attachment provides plate with holes on each plate(right and left) allowing to receive a tool to screw in the holes to the gate post. When it opens it drags. Additionally, no lubrication is provided, rusting is inevitable, the metal wears out. Conventional hinges are designed with a predetermined weight. Non-adjustable hinge may counterbalance a gate by one manufacturer and fail to counterbalance a comparably sized gate door made by another.

The metal hinge assembly exceeds standard hinges with pre determined weight having approached with non adjustable or coarsely adjustable hinge may counter balance a gate by one manufacture and fail to counterbalance a comparably sized gate door made by another mfg.

To one degree or another a force to counteract the weight of the gate as it opens and closes, resulting in robustly gate construction and non adjustable hinge to the door, no allowance for adjustment either horizontally, vertically. Therefore, the top dimension is not equal to the bottom condition. The general operation was to add shims to the spacing in an effort to level the gate door.

A solution to the above is to provide this hinge assembly with vertical and horizontal ability. Saving unnecessary labor and providing a quality product to the consumer

SUMMARY OF THE INVENTION

It is an object of the present invention to solve the aforementioned problems and provide an installation structure of a hinge assembly that attaches between a (gate or post) for use with a metal gate door to provide an adjustable connection.

In order to accomplish the aforementioned object of the present invention, there is provided a horizontal and vertical assembly hinge comprising:

- a connecting cylindrical housing of cold rolled steel for vertical adjustment
- a attached supporting arm including attached rod for horizontal adjustment
- a attached housing to include chamber for alien screw, grease fitting
- a ball bearing chamber

Figure 1:
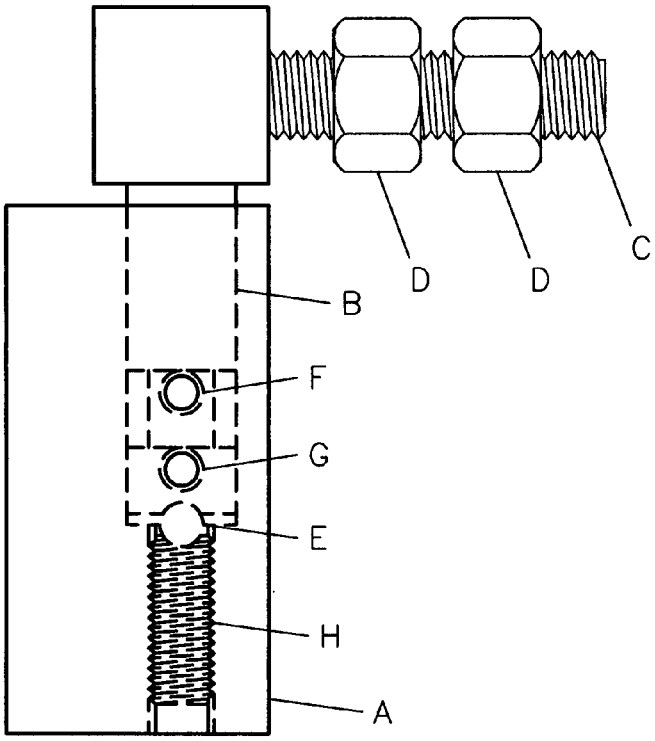
FIG. 1: a perspective view of an invention-related adjustable hinge in the unassembled state.
Figure 2:
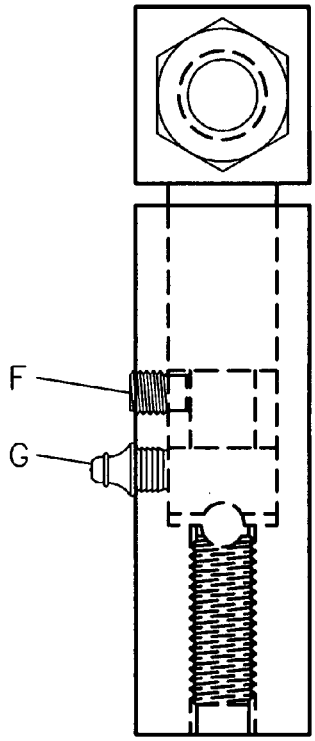
FIG. 2: a front view of the invention-related adjustable hinge, according to FIG. 1.
Figure 3:
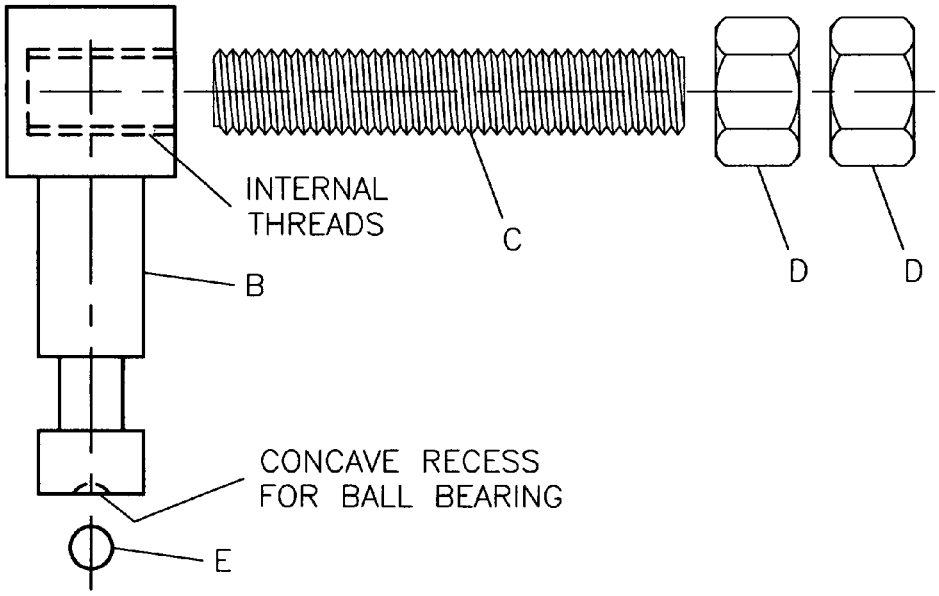
FIG. 3: a aerial view of he hinge assembly dis-assembled for horizontal adjustment
Figure 4:
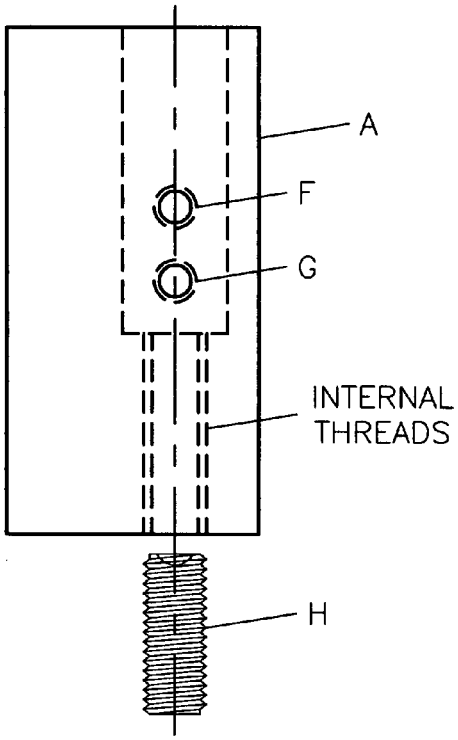
FIG. 4: a dis-assembed plan view of the hinge set screw and grease fitting FIG. A: a external side view of the housing illustrating the internal components of the hinge FIG. B: a view of the rotating support arm that allows vertical adjustment FIG. C: a external view supports the gate door with threaded rod FIG. D. a illustration of the nuts on the threaded rod that are removable to place behind the door and in front of the door.

FIG. E. a view of the position of the ball bearing

FIG. F. a illustration of the set screw positioned for stabilizing the gate.

FIG. G. a view of the grease fitting for lubrication

FIG. H. a view locking mechanism locking the bottom hinge to the top

SPECIFICATION

The Dura T Gate adjustable hinge features a vertical and horizontal adjustment. There are three main parts. The foundation of the hinge is a cold roll 1020 steel, 1½×1¾ wide×4" long. The top portion is made from a 1¼×1½×3⅝ solid cold roll steel. The bottom part of the hinge is counter sunk to allow a seat for the 5/16 ball bearing. ½" from the bottom of the hinge is a ⅛" groove, ⅝" long for the locking set screw to allow vertical adjustment and lock the bottom portion of the hinge to the top of the hinge.

Contractors commonly contract with owners of projects for metal gates. In the construction process the two gate posts are cast in concrete first. An opening is made for the concrete to be poured into. The gate post are generally made with 4×4 square tube and they are inserted into that opening, the tube is generally always smaller than that opening. The opening for the concrete post has been dug too deeply, when the concrete dries the gate post is out of alignment. This results in the top dimension not being equal to the bottom dimension for the metal gates to be mounted in a straight manner.

Metal gates do get out of adjustment due to the elements and standard wear and tear. Metal shrinks in the summer and expands in the winter.

What is claimed is:

1. A vertically and horizontally adjustable metal hinge assembly attached to a gate, for commercial use with trash gate enclosures and trash bins, to keep waste from public view; said hinge assembly comprising:

a base of the hinge being welded to a post of a gate or jamb, an upper portion of the base of the hinge receiving a swivel portion secured therein, the post being attached to a gate with two ¾ jamb nuts which are horizontally adjustable along a threaded portion; one of the two nuts being place on one side of a gate frame and the other of the two nuts being placed on another side of the gate frame; an allen screw placed inside the base hinge to allow for vertical adjustment; a ball bearing is placed between the top of the vertical allen screw and the swivel portion; an allen screw is screwed inside the base for locking the swivel portion; and grease fitting screws are provided within the base.

* * * * *